US005658162A

United States Patent [19]

Harting et al.

[11] Patent Number: 5,658,162

[45] Date of Patent: Aug. 19, 1997

[54] ELECTRIC PLUG AND SOCKET CONNECTOR

[75] Inventors: Dietmar Harting, Espelkamp; Herbert Junck, Luebbecke; Albert Ferderer, Espelkamp; Martin Schmidt, Huellhorst; Hartmut Schwettman, Rahden, all of Germany

[73] Assignee: Harting Elektronik GmbH, Espelkamp, Germany

[21] Appl. No.: 504,009

[22] Filed: Jul. 19, 1995

[30] Foreign Application Priority Data

Mar. 10, 1995 [DE] Germany ..... 195 08 605.8

[51] Int. Cl.[6] ..... H01R 13/62

[52] U.S. Cl. ..... 439/372; 439/157

[58] Field of Search ..... 439/372, 322, 439/153–160

[56] References Cited

U.S. PATENT DOCUMENTS

| | | | |
|---|---|---|---|
| 4,975,073 | 12/1990 | Weisman | 439/157 |
| 5,022,866 | 6/1991 | Hartung et al. | 439/372 |
| 5,151,041 | 9/1992 | Kaiser et al. | 439/157 |
| 5,183,408 | 2/1993 | Hatagishi | 439/157 |
| 5,213,533 | 5/1993 | Walden | 439/372 |
| 5,322,448 | 6/1994 | Hahn | 439/157 |
| 5,350,312 | 9/1994 | Kuno et al. | 439/372 |
| 5,417,579 | 5/1995 | Yoshioka et al. | 439/372 |
| 5,445,530 | 8/1995 | Inoue et al. | 439/157 |

FOREIGN PATENT DOCUMENTS

2632338C2 1/1978 Germany .

*Primary Examiner*—David L. Pirlot
*Assistant Examiner*—Brian J. Biggi
*Attorney, Agent, or Firm*—Jordan and Hamburg

[57] ABSTRACT

For an electric plug and socket connection with one or two locking shackles, which can be pivoted about bearing studs of the one half of the plug and socket connection, locking elements, disposed on the side parts of the plug and socket connection, overlapping, in the locked position of the plug and socket connection, locking studs disposed on the other half of the plug and socket connection, it is proposed that pockets be provided in the side parts and spring elements be inserted in these pockets, which spring elements act on the locking elements, or that tiltable locking elements be provided at the spring elements.

9 Claims, 6 Drawing Sheets

ELECTRIC PLUG AND SOCKET CONNECTOR

BACKGROUND OF THE INVENTION

The invention relates to an electric plug and socket connection with one or two U-shaped locking shackles, which can be pivoted about bearing studs of the one half of the plug and socket connection, locking elements/locking means, disposed at the side parts of the plug and socket connection, overlapping, in the locked state of the plug and socket connection, locking studs disposed at the other half of the plug and socket connection.

In the case of such plug and socket connections, a toggle lever action of the locking shackle is required, which ensures a satisfactory contacting pressure between the two halves of the plug and socket connection and, with respect to the locking shackle, enables the locked position to be reached relatively easily and with a defined end position.

From the DE-26 32 338 C2 it is known that, in order to fulfill these requirements, the locking shackle is made from sheet metal by bending the latter into the shape of a U and the side parts are provided with overlapping parts, which overlap the locking studs of the other half of the plug and socket connection. The locking shackle is fixed over studs at the one half of the plug and socket connection and the studs are guided in a slot-shaped opening in the side part and held by a spring element. On the whole, this locking shackle is satisfactory. However, it is expensive to make.

SUMMARY OF THE INVENTION

It is an object of the invention to provide an electric plug and socket connection of the initially-named type, which is such that the locking shackle or shackles can be manufactured easily and inexpensively.

This objective is accomplished owing to the fact that pockets, extending in the direction of the side parts, are molded into the side parts, .that in each case one spring element is inserted into each pocket, the lower end of which spring element is penetrated and held by bearing studs of the plug and socket connection half and that the upper end of the spring element, when the locking shackle is being closed, clamps over the respective locking stud of the other half of the plug and socket connection and, in so doing, acts on the locking stud in such a manner, that the two halves of the plug and socket connection are pressed against one another elastically.

The advantages achieved with the invention consists particularly therein that the locking shackles can be produced inexpensively from a plastic material by injection molding and that the spring elements, intended to produce the locking forces, are inserted simply into the pockets in the side parts and held when the locking shackle is snapped onto the corresponding bearing studs at the housing. Particularly low operating forces, which nevertheless result in high closing forces, arise from the use of spring elements, on which toggle lever elements are provided which, while sliding onto the locking studs and after passing over a top dead center, swivel/tilt into the locking position.

An embodiment of the invention is described in greater detail in the following and shown in the accompanying drawings

DESCRIPTION OF THE PREFERRED EMBODIMENTS

Figure 1:
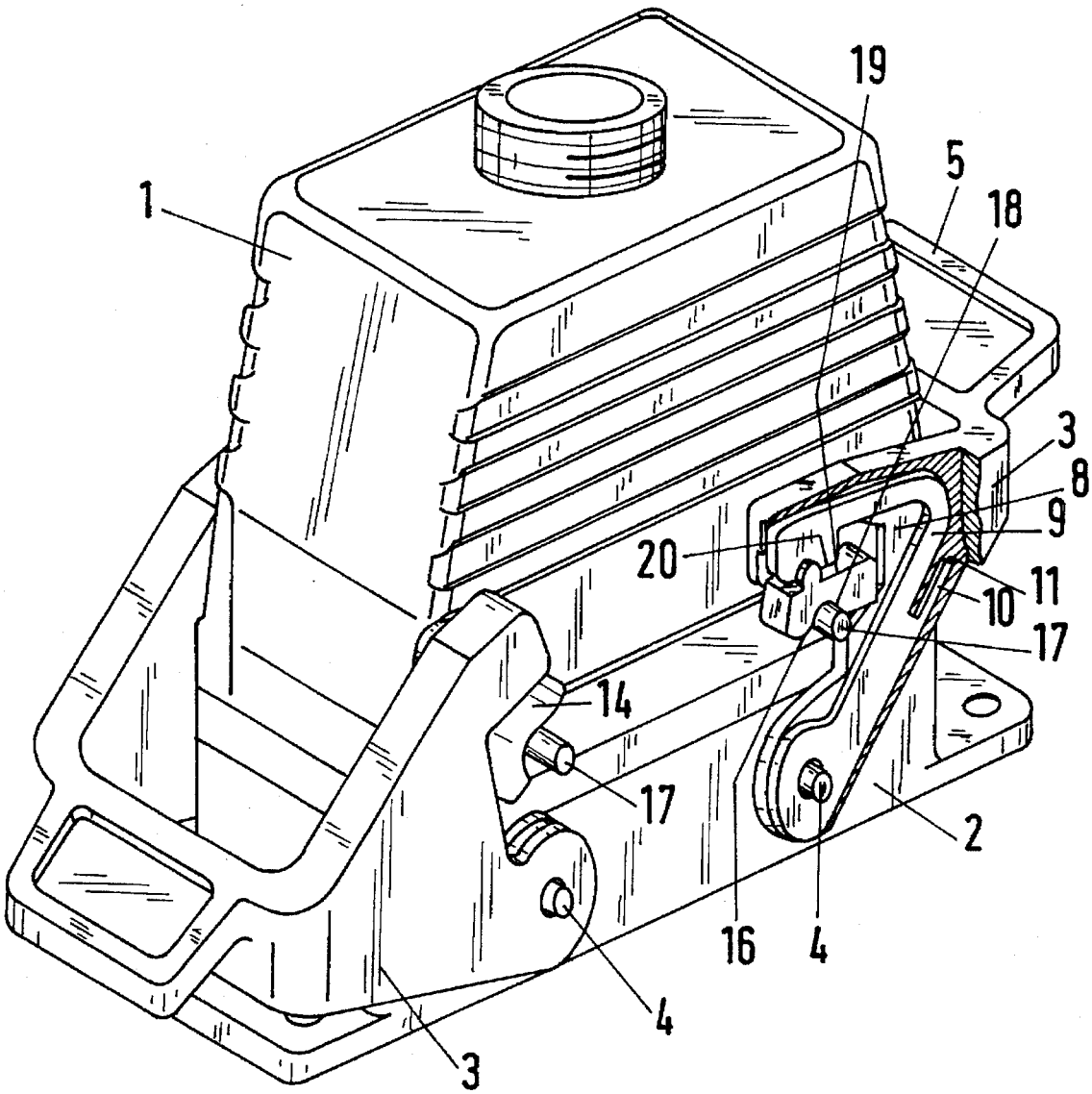
FIG. 1 shows a view of the plug and socket connection with the locking shackles.

In FIG. 1, an electric plug and socket connection is shown, two halves of the plug and socket connection 1, 2 being coupled together. The plug and socket connection halves are provided with electric contact elements, the details of which are not shown here and which make contact with one another when the plug and socket connection halves are assembled. U-shaped locking shackles 3 are provided for locking the plug and socket connection halves and are pivotably held on bearing studs 4 of the one plug and socket connection half 2.

Figure 2:
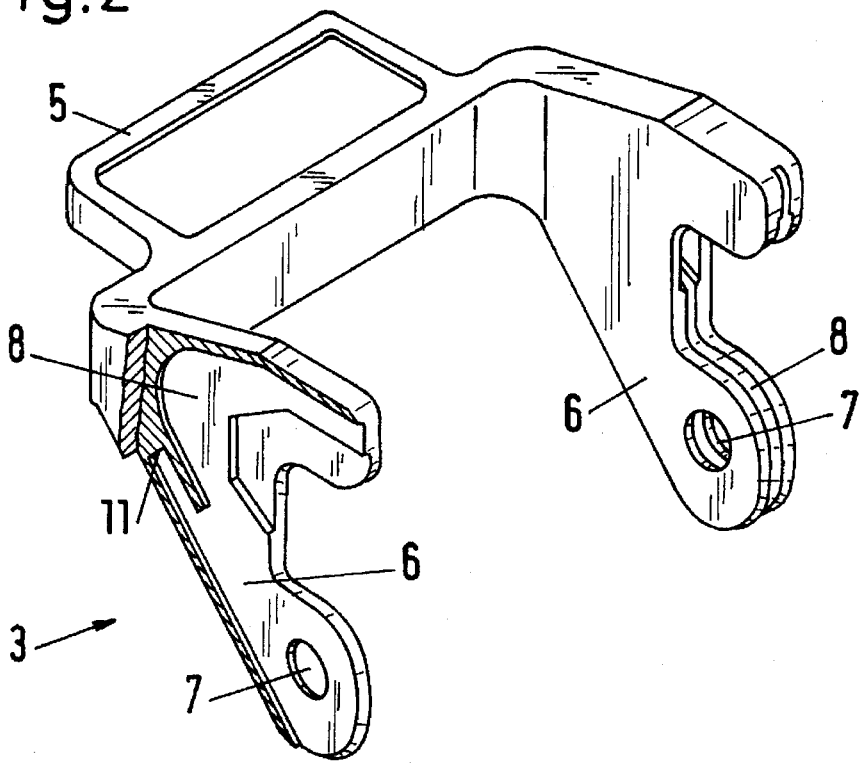
FIG. 2 shows a view of a locking shackle.
Figure 3:
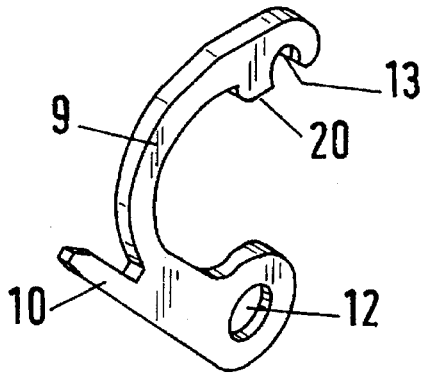
FIG. 3 shows a view of a spring element.
Figure 4:
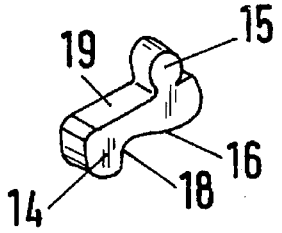
FIG. 4 shows a view of a toggle lever element.

The locking shackles, which are shown as a component part in FIG. 2, have a handle 5, from which side parts 6 extend at right angles. In the lower region of the side parts, in each case one bearing opening 7 is provided, through which the respective bearing stud 4 extends after the locking shackle is installed on the plug and socket connection half 2. The locking shackles preferably are made from plastic. Narrow pockets 8, which extend in the direction of the side parts and are open towards the front, are molded into the side parts 6. The spring elements 9, shown in FIG. 3, are inserted into these pockets, a projection 10 of the spring elements being pushed into a holding recess 11 of the pocket. In order to achieve good spring properties, the spring elements preferably are produced from a metallic material.

In the lower region of the spring elements, an eyelet extension with an opening 12 is provided, which is flush with the bearing opening 7 of the side parts after the Spring element is inserted.

In the upper region of the approximately semicircular spring element, there is an opening 13, in which the locking element 14, shown in FIG. 3, is inserted. The locking element has an approximately circular protrusion 15, which is shaped to correspond to this opening, so that this locking element is held pivotably at the spring element. The shapes of the opening 13 and of the protrusion 15 are matched to one another in such a manner that the protrusion can be inserted into the opening from the side and cannot slip out in the downward direction. The locking element is provided with a cam-like contour 16, which slides onto the locking studs 17 of the plug and socket connection half 1 when the plug and socket connection halves are being locked, the locking studs 17 lying against the curvature 18 in the end position of the locking shackle. The way, in which the locking process functions, is explained in the following by means of FIG. 1. In order to identify the mode of action of the locking shackle better, different positions are shown in FIG. 1 and the pockets of the side parts are shown with the front wall broken away. The left locking shackle is shown in a position, in which the locking element 14 strikes against or slides onto the locking stud 17. As the locking shackle is closed further, the spring element 9 is bent open, the locking element slides with its contour 16 along the locking stud and finally, after passing over a top dead center, reaches the end position, which is shown for the right locking shackle. For this movement into the end position of the locking shackle, the locking element pivots and the locking stud 17 finally lies in the curvature 18. Due to the fact that the contour 16 has an appropriate shape and the upper region 19 lies against an edge 20 of the spring element, it is ensured that the locking element remains in this position. From the point of view of its action, the locking element is constructed as a toggle lever element. In the locked position, the force of the spring element acts in such a manner, that the plug and socket connection halves are pressed firmly together.

Figure 5:
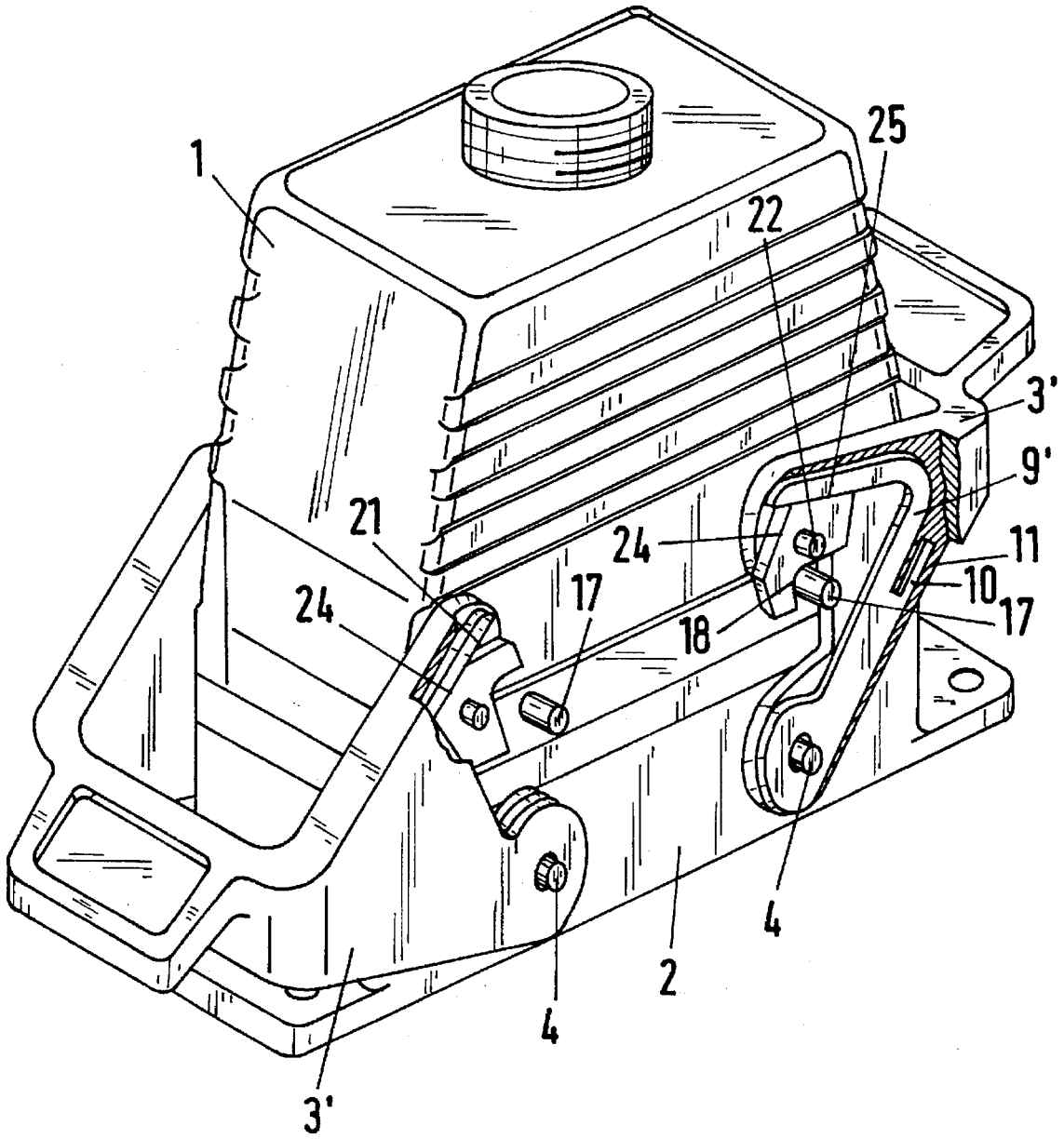
FIG. 5 shows a view of a plug and socket connection with modified locking shackles.
Figure 6:
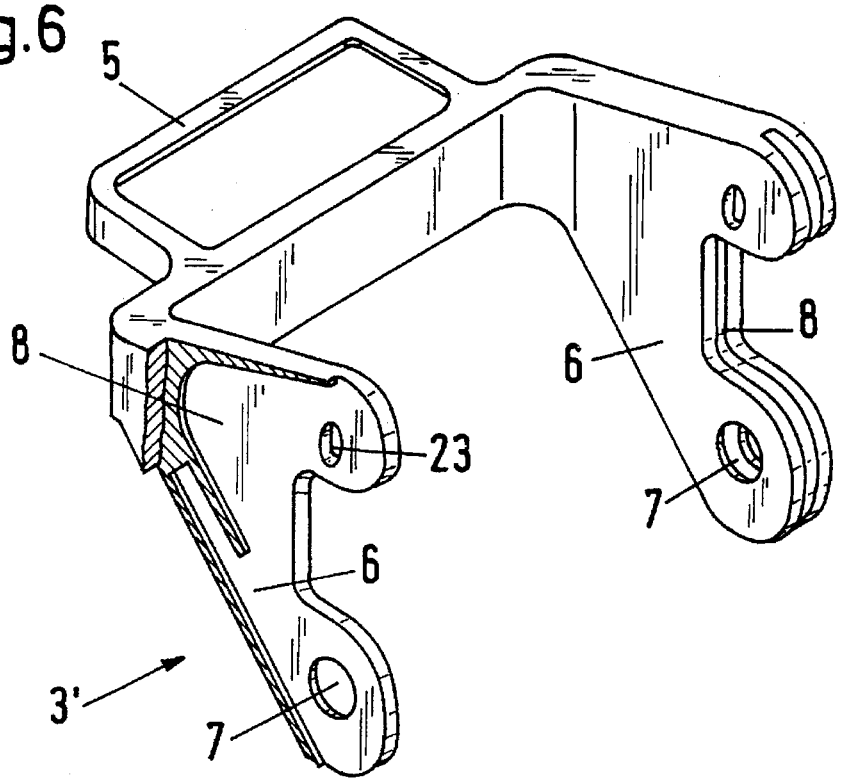
FIG. 6 shows a view of a modified locking shackle.

FIG. 5 shows an electric plug and socket connection with modified locking shackles 3'. Here also, U-shaped locking shackles are provided, which are held pivotably on bearing studs 4 of the plug and socket connection half 2. These locking shackles also, which are shown as a component part in FIG. 6, have a handle 5, from which side parts 6 extend at right angles. In the lower region of the side parts, in each case a bearing opening 7 is provided, through which the respective bearing stud 4 extends after the locking shackle is installed on the plug and socket connection half 2.

Figure 7:
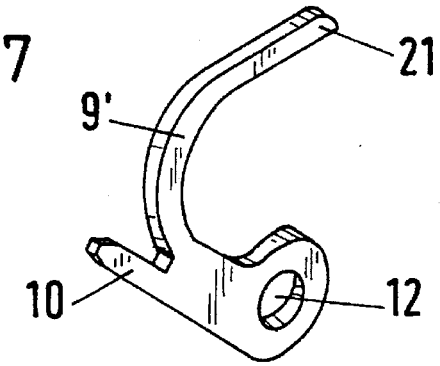
FIG. 7 shows a view of a modified spring element.

These locking shackles are also preferably produced from plastic. In the side parts 6, narrow pockets 8 are molded, which extend in the direction of the side parts and are open towards the front. As shown in FIG. 7, spring elements 9' are inserted in these pockets, an extension 10 of the spring elements being pushed into a holding recess 11 of the pocket. In order to achieve good spring properties, the spring elements are preferably produced from a metallic material. In the lower region of the spring elements, an eyelet extension with an opening 12 is provided, which is flush with the bearing opening 7 of the side parts after the spring element is inserted.

Admittedly, this spring element 9' is somewhat also semicircular. However, in contrast to the spring element 9 described above, this spring element 9' has a smooth upper end 21.

Figure 8:
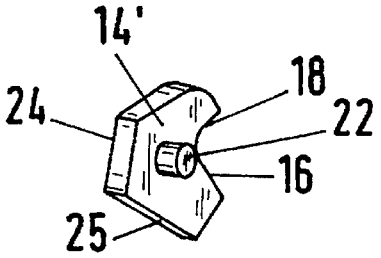
FIG. 8 shows a view of a modified toggle lever element.

The locking elements 14', shown in FIG. 8, are provided for the locking shackle. These are approximately triangular, but are provided with a curved contour 16', which slides onto the locking stud 17 of the plug and socket connection half 1 during the locking of the plug and socket connection halves, the locking stud 17 lying against the curvature 18 in the end position of the locking shackle. Moreover, these locking elements have bearing or holding studs 22. In the upper region of the side parts of the locking shackle, the locking elements are pushed into the pockets and are pivotably held by bearing studs, which are snapped into the elongated holes 23. The upper end 21 of the spring element initially presses elastically onto the surface 24 of the locking elements.

The mode of action of the locking process is explained below with the help of FIG. 5. In order to identify the mode of action better, the locking shackles are shown in different positions in FIG. 5 and the pockets of the side parts are drawn with the front wall broken away. The left locking shackle is shown in a position, in which the locking element 14' strikes against or slides onto the locking stud 17. As the locking shackle is closed further, the locking element 9' slides with its contour 16' along the locking stud and finally, after passing over top dead center, tilts into the end position, which is shown for the right locking shackle. The surface 25 then lies against the upper end of the spring element or the spring element presses on the locking element and the locking stud 17 lies in the curvature 18. By guiding or holding the locking element in the elongated holes 23, it is ensured that the pressure of the spring elements acts over the locking elements on the locking stud and that the halves of the plug and socket connection are firmly pressed together.

Figure 9:
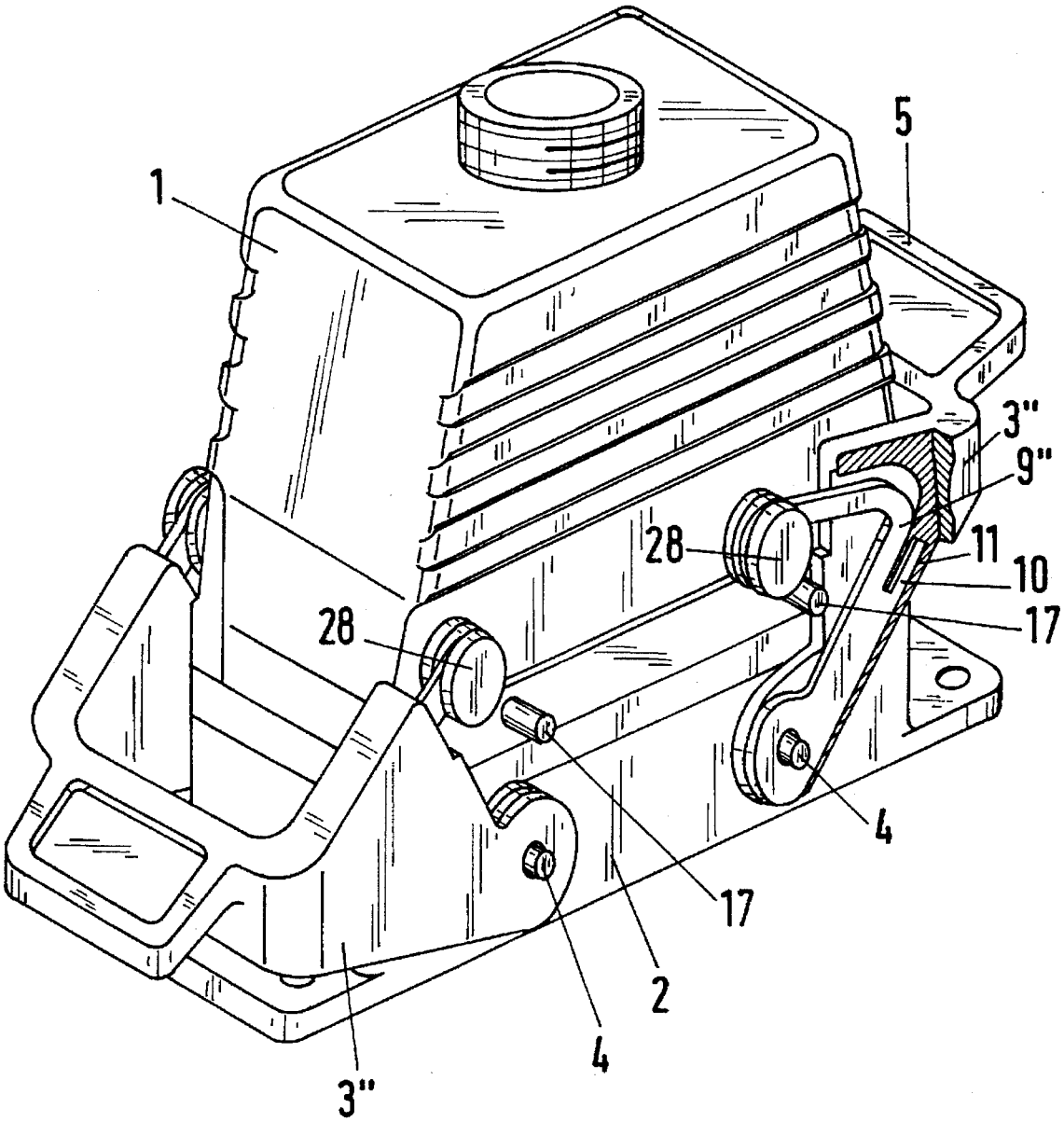
FIG. 9 shows a view of a plug and socket connection with further, modified locking shackles.
Figure 10:
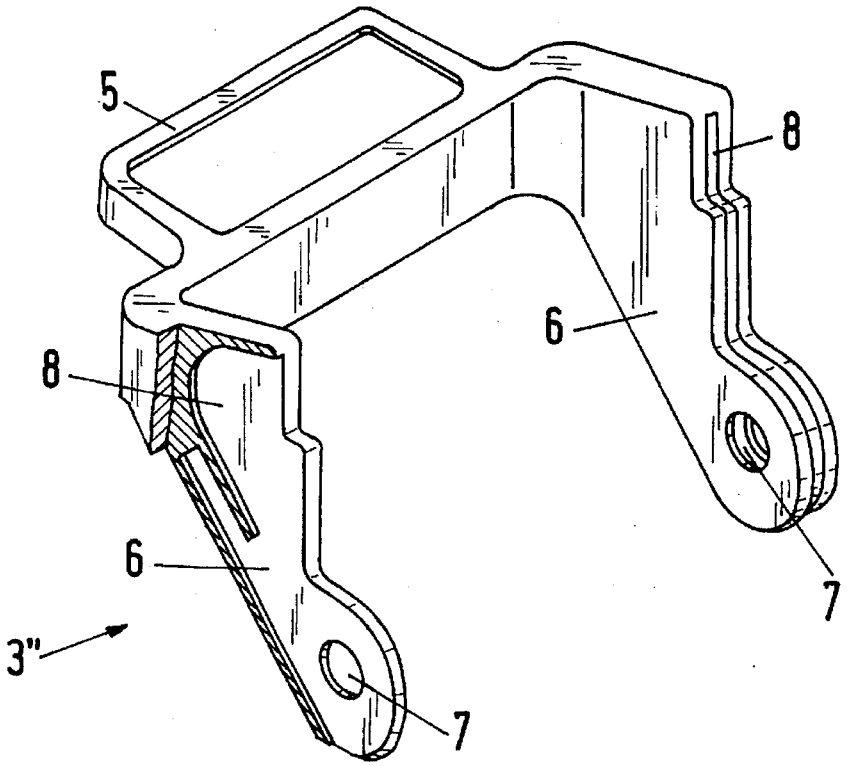
FIG. 10 shows a view of a further modified locking shackle.
Figure 11:
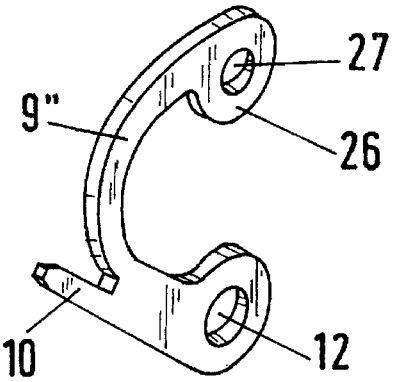
FIG. 11 shows a view of a further modified spring element.

FIG. 9 shows an electric plug and socket connection with a locking shackle 3", which has been modified further. Here also, U-shaped locking shackles are provided, which are held pivotably on the bearing stud 4 of the plug and socket connection half 2. These locking shackles, which are shown as a component part in FIG. 10, also have a handle 5, from which side parts 6 extend at right angles. In the lower region of the side parts, in each case one bearing opening 7 is provided, through which the respective bearing stud 4 extends after the locking shackle is installed on the plug and socket connection half 2. These locking shackles also are preferably made from plastic. Narrow pockets 8, which extend in the direction of the side parts and are open towards the front, are molded into the side parts 6. The spring elements 9", shown in FIG. 11, are inserted in these pockets, a projection 10 of the spring elements being pushed into a holding recess 11 of the pocket. In order to achieve good spring properties, the spring elements preferably are produced from a metallic material. In the lower region of the spring elements, an eyelet extension with an opening 12 is provided, which is flush with the bearing opening 7 of the side parts after the spring element is inserted.

Figure 12:
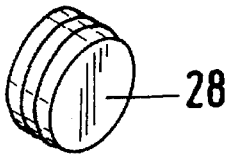
FIG. 12 shows a cylinder for the spring element of FIG. 11.

This spring element 9" admittedly is also semicircular. In contrast to the spring elements described above, however, it is provided at the upper end with a circular extension 26. Provisions can be made that the spring element, as already explained above, is inserted into the pockets of the locking shackle and that the extension slides directly over the respective locking stud when the locking shackle is being closed. After the extension has passed over an upper top dead center, the halves of the plug and socket connection are firmly pressed together by the force of the spring element. Preferably, however, to reduce frictional resistance, that is, to make the closing of the locking shackles easier, provisions are made so that the upper end is provided with an opening 27, in which the cylinder 28, shown in FIG. 12, is accommodated.

The mode of action of this locking system is explained in the following with the help of FIG. 9. In order to identify the mode of action of the locking shackle better, different positions are shown in FIG. 9 and the pockets of the side parts are shown with the front wall broken away. The left locking shackle is shown in a position, in which the cylinder 28 strikes against or slides onto the locking stud 17. As the locking shackle is closed further, the cylinder 28 slides/rolls over the locking stud and finally, after passing over a top dead center, reaches the end position, which is shown for the right locking shackle. The force of the spring elements now acts on the locking studs and the plug and socket connection halves are pressed firmly together.

We claim:

1. An electrical connector connecting first and second connector parts comprising pivot support means on said first connector part, shackle means pivotally mounted on said pivot support means for pivotal movement between a contact position and a lock position, a locking stud on said second connector part, said shackle means comprising a shackle body having a pocket and a spring means disposed in said pocket, actuating means actuated by said spring means such that when said shackle means is moved from said contact position to said lock position, said actuating means biasingly locks on to said locking stud to thereby biasingly lock said first and second connector parts together, and pivot support means on said spring means pivotally supporting said actuating means on said spring means.

2. An electrical connector connecting first and second connector parts comprising pivot support means on said first connector part, shackle means pivotally mounted on said pivot support means for pivotal movement between a contact position and a lock position, a locking stud on said second connector part, said shackle means comprising a shackle body having a pocket and a spring means disposed in said pocket, actuating means actuated by said spring means such that when said shackle means is moved from said contact position to said lock position, said actuating means biasingly locks on to said locking stud to thereby biasingly lock said first and second connector parts together, and pivotal support means on said shackle body pivotably supporting said actuating means on said shackle body.

3. An electrical connector connecting first and second connector parts comprising pivot support means on said first connector part, shackle means pivotably mounted on said pivot support means for pivotal movement between a contact position and a lock position, a locking stud on said second connector part, said shackle means comprising a shackle body having a pocket and a spring means disposed in said pocket, actuating means actuated by said spring means such that when said shackle means is moved from said contact position to said lock position, said actuating means biasingly locks on to said locking stud to thereby biasingly lock said first and second connector parts together, and rotatable means on said spring means rotatably mounting said actuating means on said spring means.

4. An electrical connector connecting first and second connector parts comprising pivot support means on said first connector part, shackle means pivotably mounted on said pivot support means for pivotal movement between a contact position and a lock position, a locking stud on said other connector part, said shackle means comprising a shackle body having a pocket and a spring means disposed in said pocket, and actuating means actuated by said spring means such that when said shackle means is moved from said contact position to said lock position, said actuating means biasingly locks on to said locking stud to thereby biasingly lock said first and second connector parts together, said actuating means having a protrusion, said spring means having an open-ended receiving eyelet which receives and retains said protrusion, said open-ended receiving eyelet rotatably supporting said protrusion.

5. An electrical connector connecting first and second connector parts comprising pivot support means on said first connector part, shackle means pivotably mounted on said pivot support means for pivotal movement between a contact position and a lock position, a locking stud on said second connector part, said shackle means comprising a shackle body having a pocket and a spring means disposed in said pocket, said spring means comprising a support section, a sprung section and an intermediate section between said support section and said sprung section, said intermediate section having a generally arcuate configuration, said pivot support means pivotably supporting said support section, and actuating means actuated by said spring means such that when said shackle means is moved from said contact position to said lock position, said actuating means biasingly locks on to said locking stud to thereby biasingly lock said first and second connector parts together, said actuating means being actuated by said sprung section.

6. An electric connection according to claim 5 wherein said support section has a projection, said pocket having a recess receiving said projection to preclude relative movement between said support section and said shackle means.

7. An electric connection according to claim 5 wherein said support section and said intermediate section of said spring means are disposed substantially complete within said pocket.

8. An electrical connector connecting first and second connector parts comprising pivot support means on said first connector part, shackle means pivotably mounted on said pivot support means for pivotal movement between a contact position and a lock position, a locking stud on said second connector part, said shackle means comprising a shackle body having a pocket and a spring means disposed in said pocket, said shackle means having two spaced, flat, generally parallel pocket side walls which partially define said pocket, said spring means having two spaced, flat generally parallel side walls juxtaposed to said pocket side walls such that said spring means is thereby sandwiched in said pocket between said pocket side walls, and actuating means actuated by said spring means such that when said shackle means is moved from said contact position to said lock position, said actuating means biasingly locks on to said locking stud to thereby biasingly lock said first and second connector parts together.

9. An electrical connector connecting first and second connector parts comprising pivot support means on said first connector part, shackle means pivotably mounted on said pivot support means for pivotal movement between a contact position and a lock position, a locking stud on said second connector part, said shackle means comprising a shackle body having a pocket and a spring means disposed in said pocket, said pocket having a closed end and an open end, said spring means being insertable into said pocket through said open end of said pocket, and actuating means actuated by said spring means such that when said shackle means is moved from said contact position to said lock position, said actuating means biasingly locks on to said locking stud to thereby biasingly lock said first and second connector parts together.

* * * * *